United States Patent [19]

LaSota

[11] Patent Number: 5,058,952

[45] Date of Patent: Oct. 22, 1991

[54] CONFORMABLE SEAT WITH PIVOTAL BELT SUPPORT

[76] Inventor: Laurence LaSota, 15745 N. Park, E. Detroit, Mich. 48021

[21] Appl. No.: 619,502

[22] Filed: Nov. 29, 1990

[51] Int. Cl.[5] ..... A47C 7/02

[52] U.S. Cl. ..... 297/284 A; 297/459; 5/215; 5/216

[58] Field of Search ..... 297/459, 284 A, 204; 5/211, 215–218, 446, 447

[56] References Cited

U.S. PATENT DOCUMENTS

| | | | |
|---|---|---|---|
| 1,135,877 | 4/1915 | Chalker | 5/215 |
| 3,545,808 | 12/1970 | Gescheidle | 297/216 |
| 3,697,133 | 10/1972 | Wolofski | 297/460 |
| 4,153,293 | 5/1979 | Sheldon | 297/284 |
| 4,155,592 | 5/1979 | Tsuda et al. | 297/284 |
| 4,309,058 | 1/1982 | Barley | 297/284 |
| 4,339,150 | 7/1982 | McNamara et al. | 297/284 |
| 4,354,709 | 10/1982 | Schuster | 297/284 |
| 4,452,485 | 6/1984 | Schuster | 297/284 |
| 4,462,635 | 7/1984 | Lance | 297/284 |
| 4,545,614 | 10/1985 | Abu-Isa et al. | 297/284 |
| 4,712,834 | 12/1987 | Warrick | 297/284 A |
| 4,858,992 | 8/1989 | LaSota | 297/284 |

*Primary Examiner*—Laurie K. Cranmer
*Assistant Examiner*—J. Bonifanti
*Attorney, Agent, or Firm*—Basile and Hanlon

[57] ABSTRACT

A seat includes a plurality of flexible belts, each extending in a loop about a fixed tubular member and an opposed rotatable tubular member, the tubular members being mounted in a seat frame. A pair of spaced extensible outer support arms are associated with each belt. Each pair of outer support arms is pivotally mounted on one end to rotatable support shafts on the seat frame and have upper ends slidably disposed in a belt loop to engage the points of contact between the top and bottom surfaces of a belt loop on opposite sides of a user of the seat. The belts and outer pivotal support arms are releasably latchable in the conformed position about a user. Pivotal inner leg support arms are coupled to an endmost pair of outer support arms to conform the inner portions of an endmost belt about a user.

15 Claims, 10 Drawing Sheets

CONFORMABLE SEAT WITH PIVOTAL BELT SUPPORT

BACKGROUND OF THE INVENTION

1. Field of the Invention

The present invention relates, in general, to seats and, more specifically, to seats which conform to the shape of the user.

2. State of the Art

In the seating industry, various types of seats have been developed to increase the comfort of the user, particularly in the lumbar region of the back. Such seats are particularly designed for use in motor vehicles, such as automobiles or trucks. These seats are provided with special configurations, areas of extra padding, springs, resilient or inflatable members, etc., which conform the shape of the seat more closely to the particular shape of the user.

The conformability of such previously devised seats is obtained through manual adjustments or automatically via electrically driven means. Typically, such automatic adjusting conformable seats automatically adjust to a fixed shape, even if the fixed shape is controlled by the user.

U.S. Pat. No. 4,858,992 issued to L. LaSota, the inventor of the present invention, discloses a conformable seat which automatically conforms to the shape and size of a user. In this conformable seat, a plurality of flexible belts extend laterally across a seat frame. Sensors detect the shape and position of a user of the seat and provide signals to a control unit which activates sliders mounted in channels on the sides of the frame to adjust the tension in each belt sequentially along the length of the seat to secure the belts to the exact shape and position of the user of the seat.

While this conformable seat uniquely provides a seat which conforms to the shape, size and position of a user, it has been found that certain improvements could be made to improve is operation, decrease its conforming cycle time and to reduce the complexity and number of separate components required for its construction.

Thus, it would be desirable to provide a conformable seat which conforms exactly to the shape, size and position of the user. It would also be desirable to provide a conformable seat which quickly completes its conformability cycle. It would also be desirable to provide a conformable seat which conforms to many different sizes, shapes and weights of users and to any position of the user on the seat.

SUMMARY OF THE INVENTION

The present invention is a seat which automatically conforms to the shape, size, weight and position of a user. The seat includes a frame. First and second tubular members are mounted on opposite sides of the frame. The first tubular member is rotatably mounted on the frame. A plurality of belts are spaced along the frame. Each of the belts is in the form of a loop having spaced top and bottom portions extending laterally across the frame. The opposite ends of each belt loop extend around the first and second tubular members, with the first end of each belt wrapped in an extensible reel about the first tubular member.

Belt lock means are provided for locking each belt in a fixed extended position relative to the first tubular member. Outer support means, mounted on the frame and associated with each belt engage the point of contact of the top and bottom portions of each belt loop after a user has sat on the conformable seat causing the top portion of each belt to contact the bottom portion of each belt. Means are provided for locking the support means in a position engaged with the belt. Finally, the conformable seat includes means for rotating the outer support means and for locking and unlocking the belt lock means.

In a preferred embodiment, the outer support means comprises third and fourth shafts which are rotatably mounted on opposite sides of the frame below the first and second tubular members. Pairs of first and second, co-planar, outer support arms are spacedly mounted along the third and fourth shafts, with the first outer support arm of each pair of outer support arms mounted on the third shaft and the second outer support arm of each pair of outer support arms mounted on the fourth shaft. Each outer support arm includes a base rotatably mounted on the respective third or fourth shaft and an extensible and retractable extension member telescopingly mounted within the base. The upper end of the extension member is disposed between the top and bottom portions of one of the belts and is normally positioned adjacent one of the first and second tubular members. Releasable latch means are provided on each of the first and second outer support arms to latch the extension member of each of the first and second outer support arms in an extended position. Means are also mounted on the frame and each of the first and second outer support arms for releasably latching the base member of each of the first and second outer support arms in a fixed position.

Friction brake means are also mounted on the third and fourth shafts adjacent the base members of each of the first and second outer support arms for frictionally engaging the base member to transmit rotation from the respective third and fourth shafts to each base member. In one embodiment, means are provided extending between the extension member latching means and the base member latching means for connecting both latching means together for simultaneous movement between latching and unlatching positions. In another embodiment, a single latch performs the latching of the extension member and the pivotal outer arm base member.

The belt lock means preferably comprises a friction brake mounted on the first tubular member adjacent to and frictionally engaging one side of a belt spool rotatably mounted on the first tubular member to control the unwinding of the belt from the spool when a user sits on the seat. A release latch cam is also mounted on the first tubular member adjacent the other side of each belt spool. The release latch cam engages a latch which is operably coupled to a solenoid latch release to lock the belt spool in a fixed position either conforming the belt attached to the particular spool to the shape of the user on that particular portion of the seat or in the reset, completely rewound position. The solenoid latch trigger is activated by a depth sensor switch means mounted on the frame below one of the belts. The depth sensor switch means is activated when the belt is depressed a predetermined amount thereby indicating that the user is fully seated on the seat.

A pair of first and second inner support members may be positioned adjacent one end of the frame and associated with an endmost belt. Each of the first and second inner support members includes an elongate member having upper and lower ends. The upper end is disposed between the top and bottom portions of the associated belt. A first member is pivotally coupled to the frame. A second member is slidingly and extensibly mounted in the first member and extends outward from the first member. The second member is coupled to the lower end of the elongate member. Transfer links connected between the elongate member of the inner support arm and the second member transmit the position of the associated outer support member to the inner support member to position the inner support member in snug engagement with the user in combination with the associated outer support member.

Optionally, relative movement links may be interconnected with opposite ends of a pair of scissor-connected links extending between one of the pairs of first and second outer support members and the first and second inner support members. The relative movement links and the scissor-connected links transmit size information of the user so as to accurately position the inner support members regardless of the size and/or position of the user of the seat.

The conformable seat of the present invention affords significant advantages over previously devised conformable seats in that the present conformable seat quickly and automatically adjusts to the size, shape, weight and position of the user of the seat. The conformable seat is of simplified construction for a reduced manufacturing cost. Further, the automatic conformable cycle time of the conformable seat of the present invention is minimal so as to enable the user to reposition himself on the seat and still retain the desired conformability of the seat.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
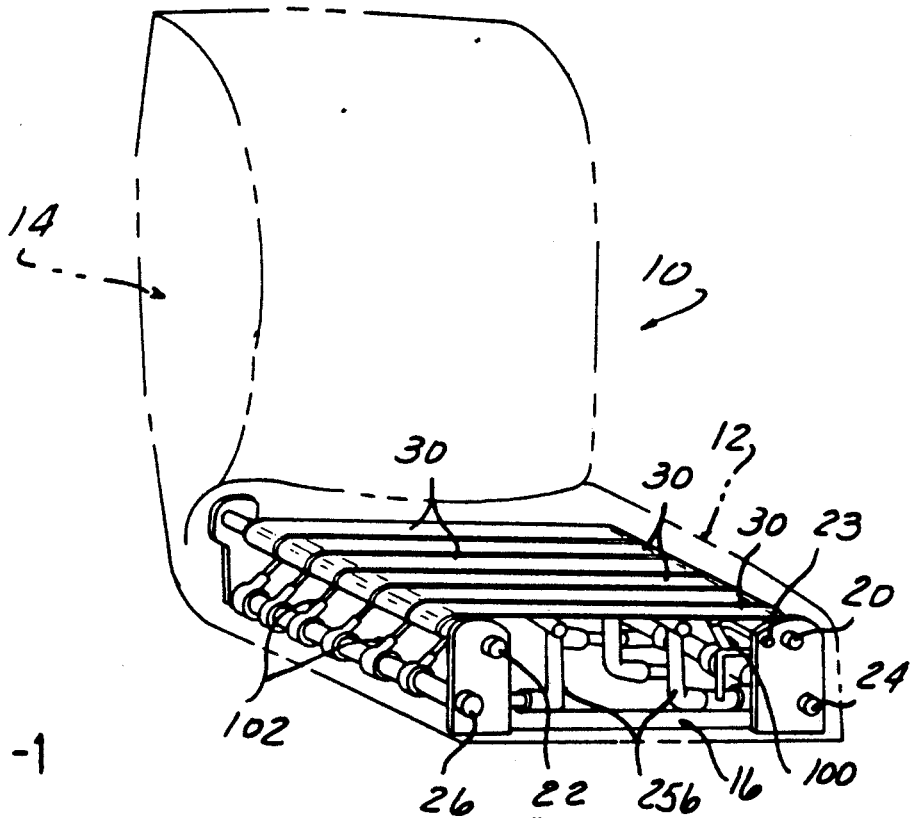
FIG. 1 is a perspective view of a conformable seat constructed in accordance with the teachings of the present invention.
Figure 2:
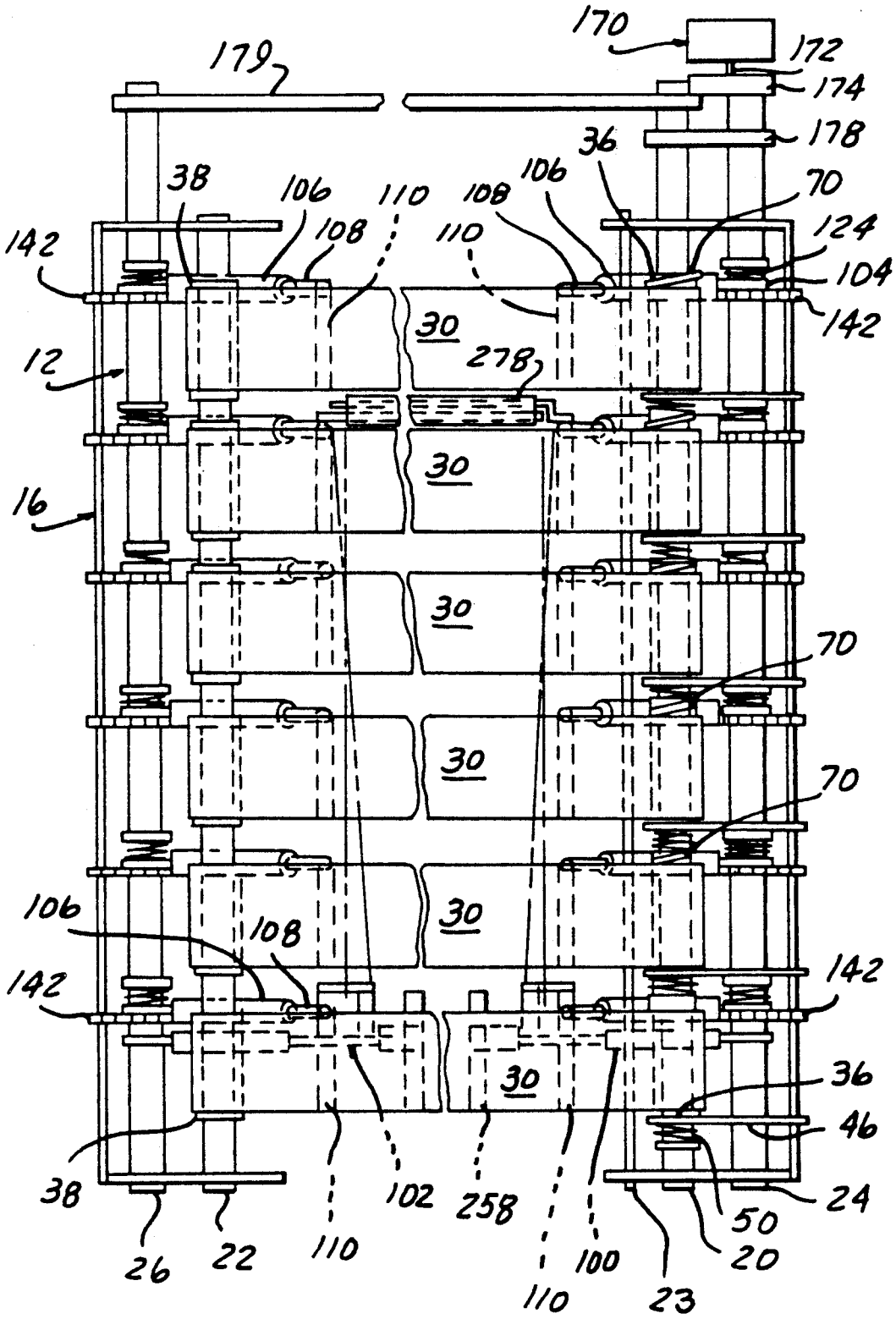
FIG. 2 is a plan view of the conformable seat shown in FIG. 1.

Referring now to the drawing, and to FIGS. 1 and 2 in particular, there is illustrated a seat 10 which conforms to the shape, size, weight and position of a user. Although the seat 10 is illustrated and described as comprising a typical seat mountable within a vehicle, such as an automobile, truck, etc., it will be understood that the features of the seat 10 may be employed in other applications, such as in both or either the seat back or seat back portions of a vehicle mounted seat, an office or residential seat, hospital bed, etc.

By way of example only, the seat 10 includes a seat bottom 12 which is fixedly or slidably mounted on the floor of a vehicle and a pivotally mounted or stationary seat back 14 shown in phantom in FIG. 1. The seat bottom 12 and the seat back 14 may be covered with any suitable material, such as cloth, vinyl, etc. In addition, although not shown, suitable padding may also be employed between the outer cover and the frame of the seat 10.

Although the conformable seat members are shown as being mounted in the seat bottom 12, it will be understood that similar conformable members may be also mounted in the seat back 14 by itself or in both the seat bottom 12 and the seat back 14.

The conformable seat 10 of the present invention includes a frame denoted generally by reference number 16. The frame 16 is formed of interconnected tubular and plate members which generally define a square or rectangular base for supporting the other elements of the conformable seat 10. The frame 16 may be fixed or slidably mounted to conventional seat rails, not shown, in a vehicle to permit fore and aft adjustment of the seat 10 in a normal manner.

As shown in FIGS. 1 and 2, and in greater detail in FIGS. 3, 4, 5 and 8, first and second tubular members 20 and 22 are mounted in the frame 16. The first and second tubular members 20 and 22 extend longitudinally along the length of the frame 16 between the front and rear of the seat bottom 12 in the orientation shown in FIGS. 1 and 2. The first and second tubular members 20 and 22 receive the flexible belts 30 as described hereafter.

Third and fourth shafts 24 and 26, respectively, are also rotatably mounted in the frame 16 and extend longitudinally along the seat bottom 12. The third and fourth shafts 24 and 26 are disposed below the first and second shafts 20 and 22 as shown in FIGS. 1 and 2.

As shown in FIGS. 1 and 2, a plurality of flexible belts 30 are spaced apart along the length of the frame 16 from the front to the rear of the frame 16. Each of the belts 30 may be formed of any suitable flexible material, such as a fabric, a synthetic material, etc.

Figure 3:
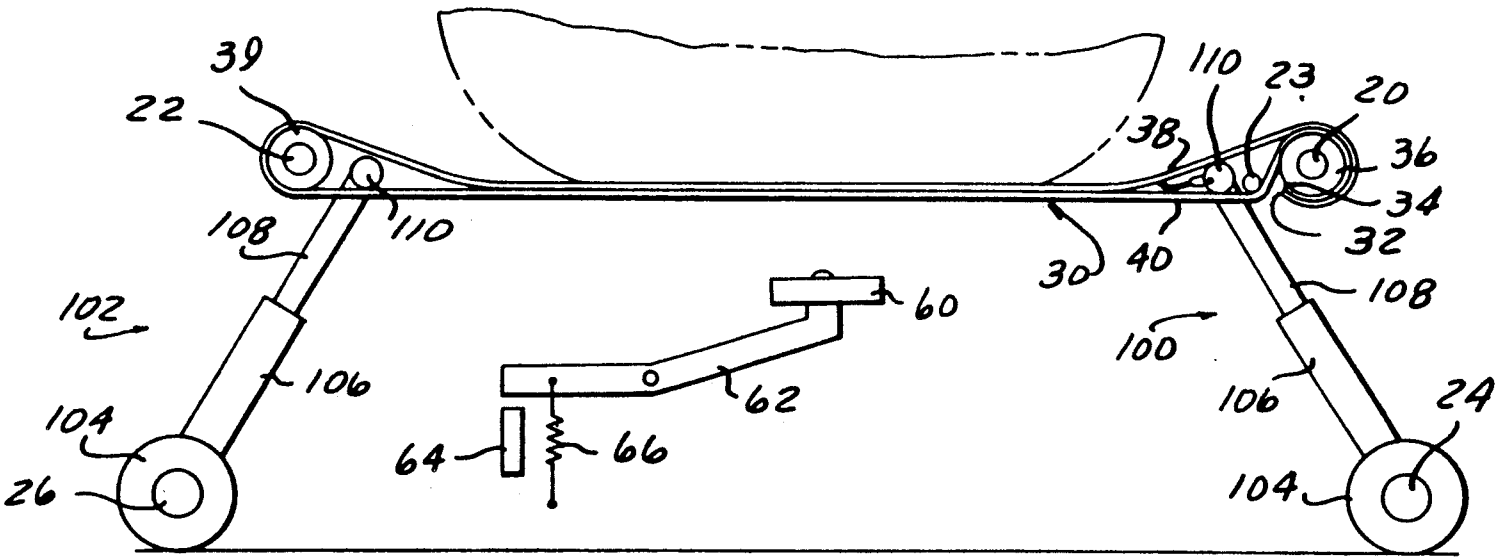
FIG. 3 is a partial front elevational view of a portion of the seat shown in FIG. 1.
Figure 4:
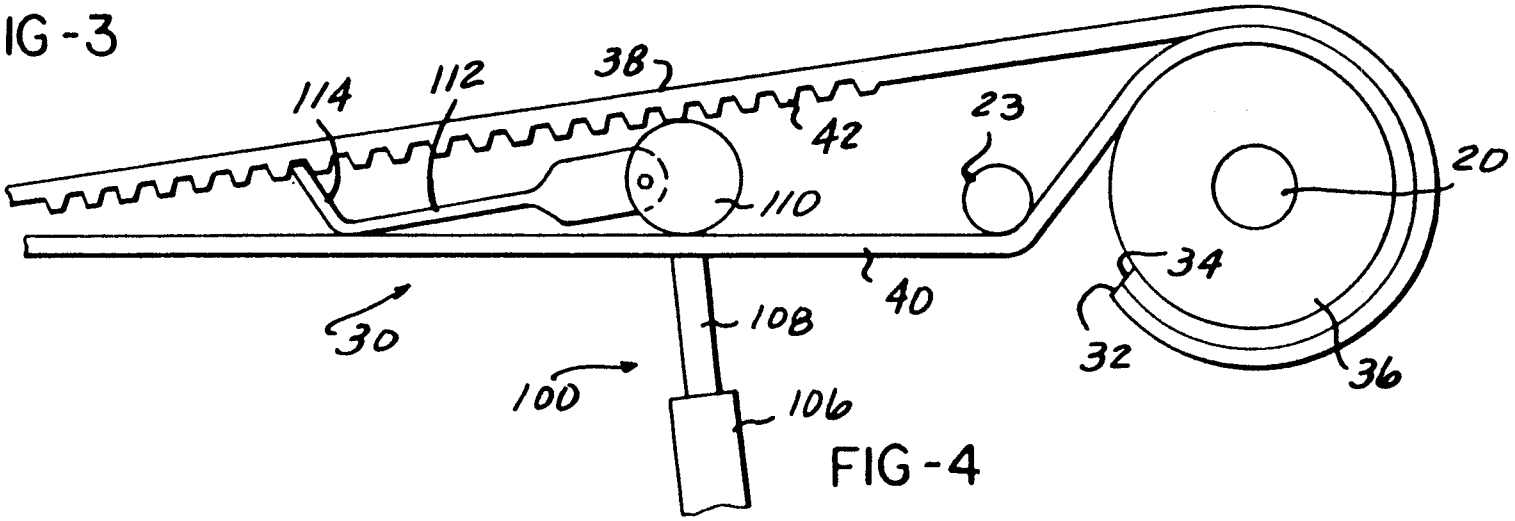
FIG. 4 is an enlarged, partial front elevational view of a portion of the seat shown in FIG. 3.

Each of the belts 30, as shown in FIGS. 3 and 4, has opposed first and second ends 32 and 34, respectively. Each of the first and second ends 32 and 34 is fixedly connected to a belt spool 36 which is rotatably mounted on the first tubular member 20. The belt 30 extends from its first end 32 through one or more turns about the spool 36 to a roller 39 rotatably mounted on the opposed second tubular member 22 and back under an idle shaft 23 fixed in the frame 16 to the spool 36. This forms a top portion 38 and a spaced bottom portion 40 on each belt 30. Normally, the top and bottom portions 38 and 40 of the belt 30 are spaced apart when the seat 10 is not in use. However, the top and bottom portions 38 and 40 are urged together, as shown in FIGS. 3 and 4 and described in detail hereafter, when a user sits on the seat 10.

Each belt 30 is generally smooth along a major portion of its length except for a portion which is disposed along the top portion 38 of each belt 30. The top portion 38 has a plurality of spaced teeth or notches 42 formed on a surface facing the bottom portion 40 of the belt 30. The purpose of the teeth 42 will become more apparent in the following description. Further, each belt 30 may be in the form of a continuous loop as shown in FIGS. 3 and 4 or made of two separate strips, one end of each being attached to the belt spool 36 and the other ends being separately attached to the frame.

Figure 5:
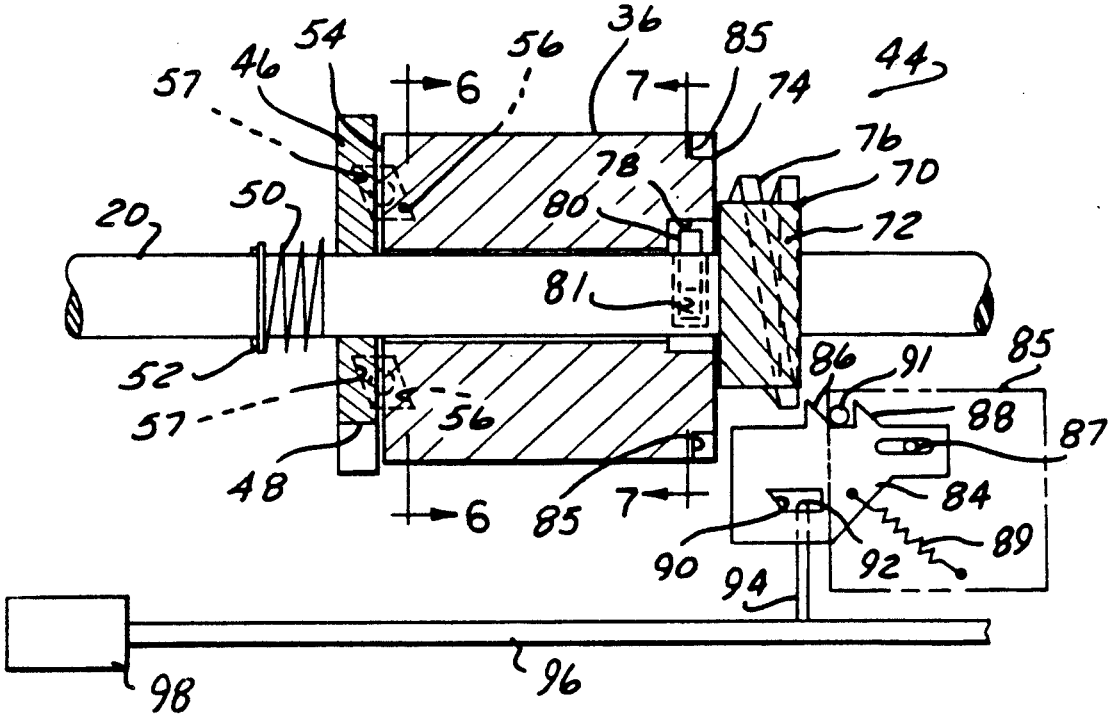
FIG. 5 is a partial, cross sectional view of the belt mounting and latch means.
Figure 6:
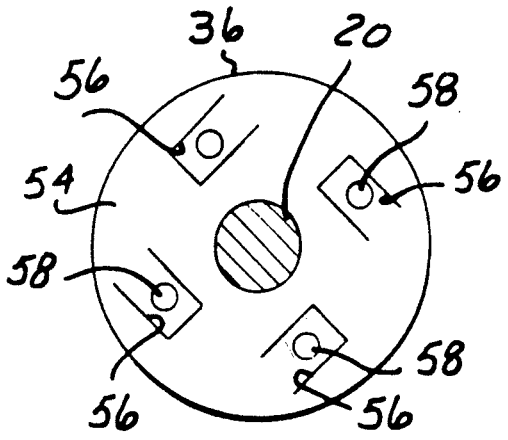
FIG. 6 is a cross sectional view generally taken along line 6—6 in FIG. 5.
Figure 7:
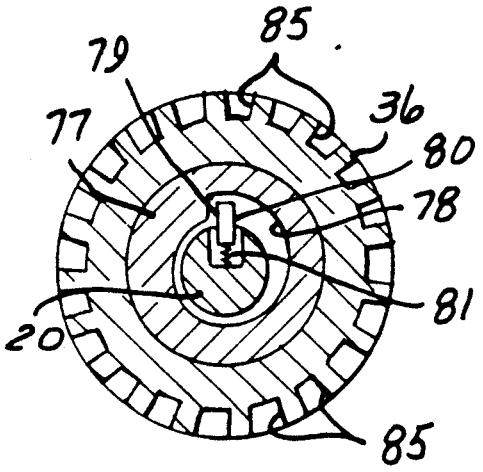
FIG. 7 is a cross sectional view generally taken along line 7—7 in FIG. 5.

Extension and retraction of each belt 30 about the respective spool 36 is controlled by a belt latch means denoted in general by reference number 44 in FIGS. 5, 6 and 7. The belt latch means 44 for each belt 30 includes a friction brake 46 in the form of an annular ring or disk slidably mounted on the first tubular member 20. The disk 46 includes a key portion 48 which slidably connects each friction brake disk 46 to a portion of the frame 16 of the seat 10. Biasing means 50 in the form of a spring biases the friction brake 46 into contact with the associated belt spool 36. The spring 50 is mounted about the first tubular member 20 and seats on a spring stop 52 fixedly mounted on the first tubular member 20.

As shown in FIGS. 5 and 6, one end face 54 of the belt spool 36 which faces the friction brake disk 46 includes a plurality of inclined ramps 56. The ramps 56 are circumferentially spaced about the face 54 and extend angularly inward from the face 54. An identical parallel arrangement of ramps 57 is formed in the facing surface of the friction brake disc 46. A rolling member, such as a ball 58, is rollably disposed within each pair of ramps 56 and 57. In operation, the biasing spring 50 will urge the friction brake disk 46 into contact with the spool 36 via the rollers or balls 58 to control the unwinding of the belt 30 from the spool 36. However, the spool 36 is free to rotate in an opposite direction upon rotation of the first tubular member 20 to retract the belts 30 to their normal, unused position. During such rotation, the balls 58 roll in the ramps 57 to a position separating the friction brake disk 46 from the spool 36.

The angle of the ramps 56 and/or 57 may be varied to vary the force applied on the spool 36 through the balls 58 and the friction brake disk 46. This enables the tension on the belts 30 to be varied fore and aft along the length of the seat 10 to accommodate normal human weight distribution of users of the seat 10.

As shown in FIGS. 5 and 7, an annular member 77 is fixedly mounted in the end face 74 of each belt spool 36 and rotates with the belt spool 36 about the first tubular member 20. The annular member 77 includes an inner spiral-shaped cam surface 78 which includes a shoulder 79.

A drive pin 80 is movably mounted in the first tubular member 20 by a biasing spring 81 which normally biases the pin 80 radially outward from the first tubular member 20. In this manner, the belt spool 36 is free to rotate in a clockwise direction as the belt 30 unwinds under the user's weight. However, opposite or counterclockwise rotation of the first tubular member 20 will eventually cause the drive pin 80 to engage the shoulder 79 in the cam surface 78 to completely reset the belt 30 attached to the spool 36.

As shown in FIG. 3, a belt depth sensor means, such as a switch 60, is located beneath one of the belts 30 in a position to be contacted by the belt 30 when a user settles into the seat 10. The switch 60 is mounted on an arm 62 which is pivotally connected to the frame 16. A stop 64, also attached to the frame 16, controls the normal position of the switch 60. A biasing spring 66 connected to the frame 16 applies a return biasing force to extend the switch 60 to its normal, raised position.

In use, when a user sits on the seat 10, the user will depress the belt 30 a predetermined amount dependent upon the user's size and weight. When the user has depressed the belt 30 a predetermined amount, the belt 30 will contact the switch 60 which generates an output signal to control circuitry, described hereafter, to lock the belts 30 in the extended position.

A belt spool latch shown generally by reference number 70 in FIG. 5 is associated with each belt spool 36. The belt spool latch 70 includes an annular member 72 fixed or pinned on the first tubular member 20 adjacent an end face 74 of a belt spool 36. The annular member 72 is provided with a latch release cam 76 in the form of an angular, spiral projection.

A latch plate 84 movably mounted in a housing 85 fixed to the seat frame is provided for each annular disk 72. The latch plate 84 includes a pair of spaced projections 86 and 88 mounted on one side thereof. The projection 86 engages the spiral projection 76 on the annular member 72 and is urged to the right in FIG. 5 as the projection 76 rotates with rotation of the first tubular member 20 to release a forward edge of the latch plate 84 from engagement with one of a plurality of peripheral slots 85 on the spool 36 thereby releasing the spool 36 from a fixed or locked position.

A slot 90 is formed in the latch plate 84 and receives a pin 92 on one end of an arm 94 connected to a latch trigger solenoid rod 96. A conventional electromechanical solenoid 98 controls the movement of the rod 96. Activation of the solenoid 98, as described hereafter, causes the pin 92 to pivot the latch plate 84 about pivot pin 87 overcoming the force of biasing spring 89 and releasing the projection 88 from engagement with a stop 91 in the housing 85. The spring 89 then urges the latch plate 84 forward into contact with one of the peripheral slots 85 on the belt spool 36 after the solenoid 98 is de-energized to reset the latch.

The conformable seat 10 also includes outer support means, mounted on the frame 16 and associated with each belt 30, for engaging the point of contact of the top and bottom portions 38 and 40, respectively, of each belt 30 after a user has sat on the seat 10 urging the top portion 38 of each belt 30 into contact with the bottom portion 40. As shown in FIGS. 1, 3, 4, 8 and 9, the outer support means preferably comprises a plurality of pairs of first and second co-planar arranged outer support arms 100 and 102. Each pair of first and second outer support arms 100 and 102, respectively, are associated with one belt 30 in the conformable seat 10. The first outer support arm 100 is rotatably mounted on the third rotatable shaft 24. The second article support arm 102 associated with each belt 30 is rotatably mounted on the fourth rotatable shaft 26. Each of the first and second outer support arms 100 and 102 are identically constructed such that the following description will be provided for only the first outer support arm 100.

The first outer support means 100 includes an annular base 104 rotatably mounted about the third tubular shaft 24, a hollow support member 106 and an extension member 108 which is slidably mounted within the support member 106 for extension and retraction movements with respect to the support member 106. A short tubular rod 110 is mounted at the upper end of the extension member 108 and extends perpendicular thereto. The tubular rod 110 is disposed between the top and bottom portions 38 and 40 of a belt 30 and is slidingly movable laterally across the belt 30, as described hereafter.

A link 112 is pivotally connected at one end to the tubular rod 110 and extends outward therefrom. A twist is formed in the link 112 to form a planar portion which terminates in an upwardly extending flange 114 as shown in FIG. 4. The distal end of the flange 114 is adapted to securely engage one of the teeth 42 in the top portion of the belt 38 to fixedly engage the outer support means 100 to the belt 30 adjacent the wedge or point of contact between the top portion 38 and the bottom portion 40 of the belt 30 when a user sits on and depresses the belt 30.

Figure 8:
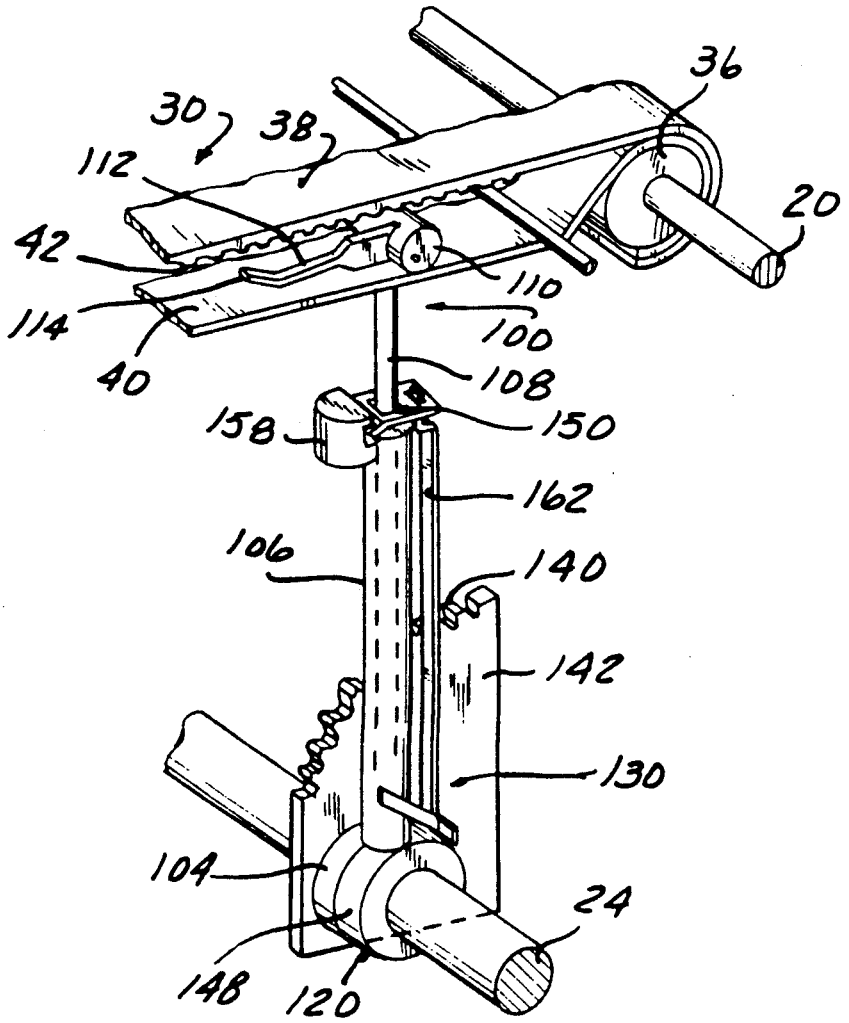
FIG. 8 is a partial perspective view showing the belt and pivotal outer support arm.

As shown in FIG. 8, a friction brake means 120 is associated with each of the outer support means, such as the first outer support means 100. The friction brake 120 is in the form of an annular member which is slidingly keyed to the third tubular shaft 24. A biasing means 124, FIG. 9, such as a coil spring, is disposed about the tubular shaft 24 between a spring seat 126 fixedly mounted on the third tubular shaft 24 and one side of the annular friction brake 120. The biasing spring 124 urges the friction disk 120 into contact with the base 104 of the outer support means 100 to transmit rotation of the third shaft 24 to pivotal rotational movement of the first outer support means 100. As described hereafter, upon rotation of the third tubular shaft 24, the first outer support means 100 pivots counterclockwise in the orientation shown in FIGS. 3 and 4 until the flange 114 on the pivotal link 112 engages one of the teeth 42 in the belt 30. This resistance overcomes the frictional force between the friction brake 120 and the base or annular collar 104 on the first outer support means 100 such that the first outer support means 100 remains in the fixed position engaged with the belt 30 despite further rotational movement of the third tubular shaft 24.

Figure 9:
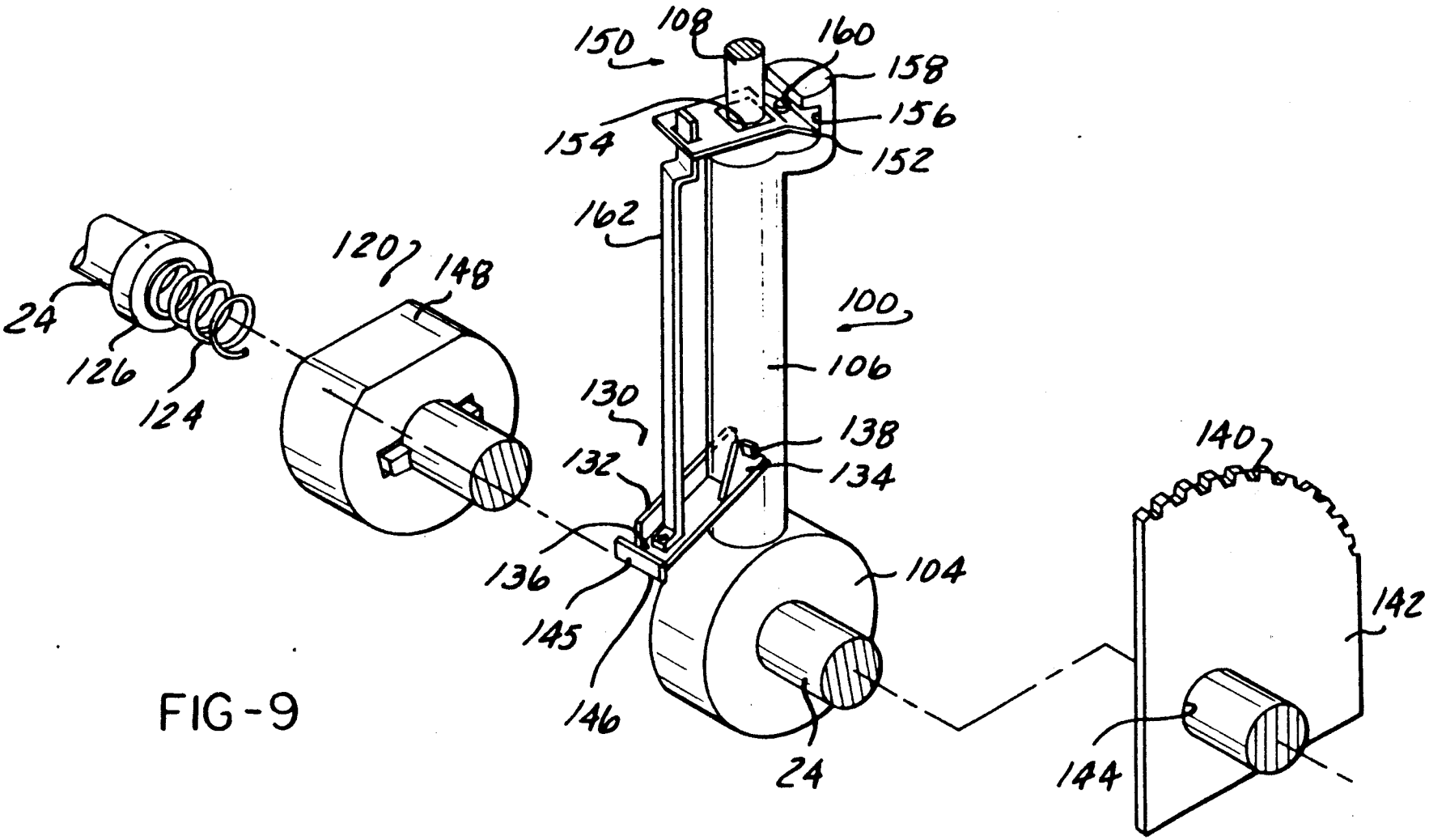
FIG. 9 is an exploded perspective view showing the pivotal outer support arm and latch means.

A first base member latch denoted by reference number 130 in FIGS. 8 and 9 is pivotally connected to the support member 106 of the first outer support means 100 and operates to latch the first outer support means 100 in a fixed position when the flange 114 of the pivotal link 112 engages one of the teeth 42 in the belt 30. The first latch 130 comprises a member having first and second side walls 132 and 134 disposed on opposite sides of a planar central portion 136. The first side wall 132 is disposed along one side of the support member 106. The second side wall 134 which has a generally upstanding triangular shape with an outwardly projecting finger 138 is disposed on the opposite side of the support member 106. The first and second side walls 132 and 134 are pivotally connected to the support member 106.

The finger 138 is adapted to engage one of a plurality of teeth 140 formed in a latch sector plate 142 which is fixedly mounted to the frame 16. The latch sector plate 142 contains an aperture 144 through which the third tubular shaft 24 extends. Pivotal movement of the first pivotal latch 130, as described hereafter, will cause the finger 138 to move into and out of engagement with the teeth 140 in the latch sector plate 142 to thereby alternately latch and release the first pivot latch 130 and the attached first outer support means 100 to and from a latched position with respect to the rotatable third tubular shaft 24.

A flange 145 including a cam follower 146 and is mounted on and extends downward from the central portion 136 of the first pivot latch 130. The cam follower 146 engages a cam surface 148 formed on an outer, annular portion of the friction brake disk 120. The cam follower 146 rides along the cam surface 148 on the friction brake disk 120 to control the pivotal movement of the first pivot latch 130.

The first outer support means 100 also includes an extension latch denoted in general by reference number 150. The extension latch 150 is in the form of a plate having an angularly bent end flange 152. The extension latch 150 is disposed above the support member 106 and includes an aperture 154 through which the extension member 108 slidably extends. The angular flange 152 is disposed within a recess 156 formed in an extension 158 of the support member 106. A biasing spring 160 is disposed in the recess 156 to normally bias the angular flange 152 in a downward direction allowing slidable extension of the extension member 108 with respect to the support member 106.

The other end of the extension latch 150 is connected to a connecting rod 162 which extends from engagement with the extension latch 150 to a fixed connection with the first pivot latch 130 as shown in FIG. 9. The connecting rod 162 thereby fixedly interconnects the first base member latch 130 and the extension latch 150 for simultaneous movement as the cam follower 146 on the first base member latch 130 traverses the cam 148 when the friction brake 120 rotates with the third shaft 24. In this manner, when the first base member latch 130 latches the first outer support means 100 in a fixed position with respect to the belt 30, the extension latch 150 will pivot in a counterclockwise direction as viewed in FIG. 9 and lock the extension member 108 in a fixed position with respect to the support member 106. Upward movement of the first base member latch 130 upon retractive rotation of the third tubular shaft 24, as described hereafter, will be transmitted by the connecting rod 162 to an upward movement of the one end of the extension latch 150 thereby permitting sliding movement of the extension member 108 with respect to the support member 106.

Figure 19:
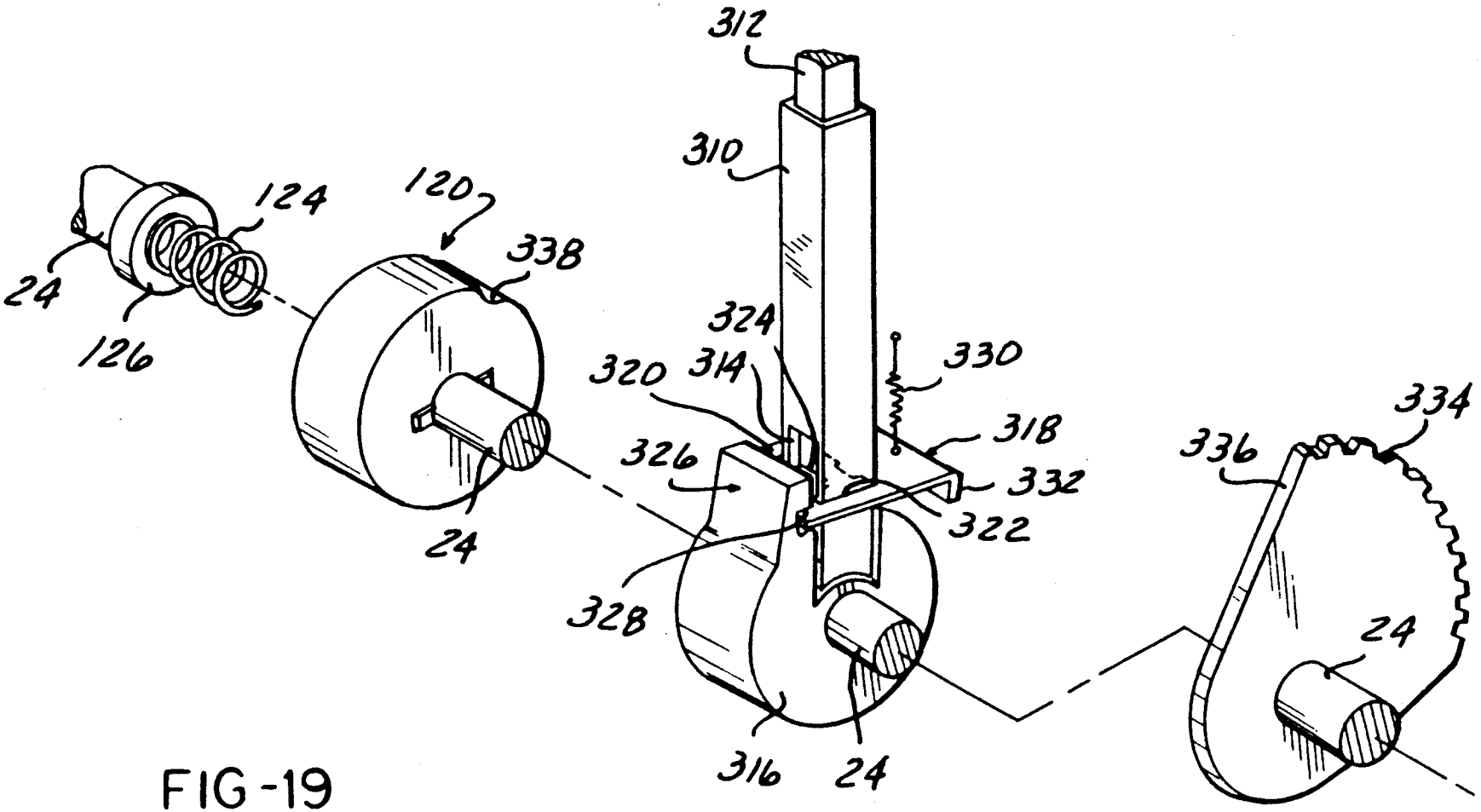
FIG. 19 is an exploded perspective view showing another embodiment of the pivotal outer arm and extension member latch means.

FIG. 19 illustrates another embodiment of the base member and extension member latch means in which a single latch member performs the function of both latches of the base member and extension member described above.

A hollow outer support member 310 and an extension member 312 are depicted by way of example only as having a square cross section. A pair of opposed slots 314 are formed in a lower portion of the outer support member as shown in FIG. 19. The members 310 and 312 are telescopingly mounted in a base member 316 which is rotatably mounted on the third tubular shaft 24.

A latch plate 318 has a planar leg 320 with a central, substantially square aperture 322 through which the outer support member 310 slidably extends. A pair of inwardly facing flanges 324 are formed on the planar leg 320 and extend inward through the slots 314 in the outer support member 310 to engage and latch the extension member 312 in a fixed position when the latch plate 318 is at an angle with respect to the sides of the extension member 312.

An outwardly extending boss 326 is formed on the base member 316 which includes a channel 328 for limiting pivotal movement of the latch plate 318. A biasing spring 330 acts on the planar leg 320 of the latch plate 318 and normally biases the latch plate 318 to a position in which the flanges 324 engage the extension member 312.

A flange 332 extends angularly from the planar leg 320 on the latch plate 318. One end of the flange 332 engages teeth 334 in a latch sector plate 336 fixedly mounted to the frame about the third tubular shaft 24. The other end of the flange 332 rides on the friction brake member 120 to engage a depression 338 in the friction brake member 120.

Rotation of the shaft 24 and the friction brake member 120 will disengage the flange 332 from the depression 338 and the teeth 334 on the latch sector plate 336 and raise one end of the latch plate 318 against the force of the spring 330. This brings the latch plate 318 to a position substantially perpendicular to the extension member 312 allowing extension or retraction of the extension member 312. When the shaft 24 rotates sufficiently, the flange 332 will engage the depression 338 and pivot until the flange 332 engages the teeth 334 in the latch sector plate 336 locking the extension member 312 and the base member 316 is a fixed position.

Figure 10:
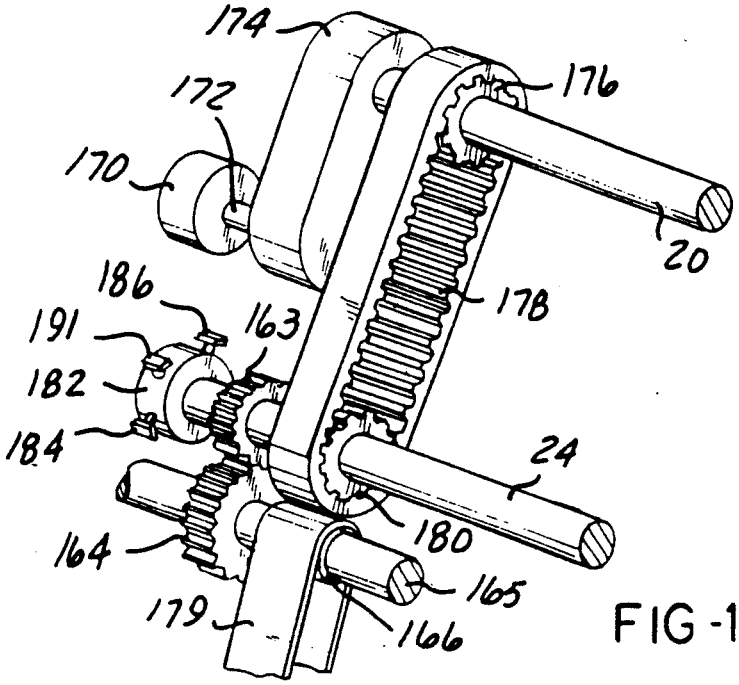
FIG. 10 is a partial, prospective view showing the drive means of the conformable seat of the present invention.

FIG. 10 shows a drive means 170 for rotating the first tubular member 20 and the third and fourth tubular shafts 24 and 26. The drive means 170 preferably comprises a bidirectional a.c. or d.c. electric motor. The motor 170 is mounted on the frame 16 by suitable mounting brackets, not shown. The output shaft 172 of the motor 170 is connected through a gear reduction means 174 to the first tubular member 20 to transmit bidirectional rotation of the output shaft 172 to bidirectional pivotal rotational movement of the first tubular member 20. A first gear 176 is mounted on the first tubular member 20 and receives a toothed drive belt 178 therearound. The other end of the drive belt 178 engages a toothed gear 180 on the third tubular shaft 24 to transmit rotation of the motor 170 to simultaneous rotation of the first tubular member 20 and the third tubular shaft 24. A gear 163 fixedly mounted on the shaft 24 engages another gear 164 fixedly mounted on an idler shaft 165 which is in turn rotatably mounted on the seat frame. A sprocket 166 is also fixed on the shaft 165 and supports a belt 179. The belt 179 extends to a similar sprocket, not shown, mounted on the fourth tubular member 26 to cause simultaneous rotation of the third and fourth tubular members 24 and 26 upon rotation of the motor 170.

Figure 11:
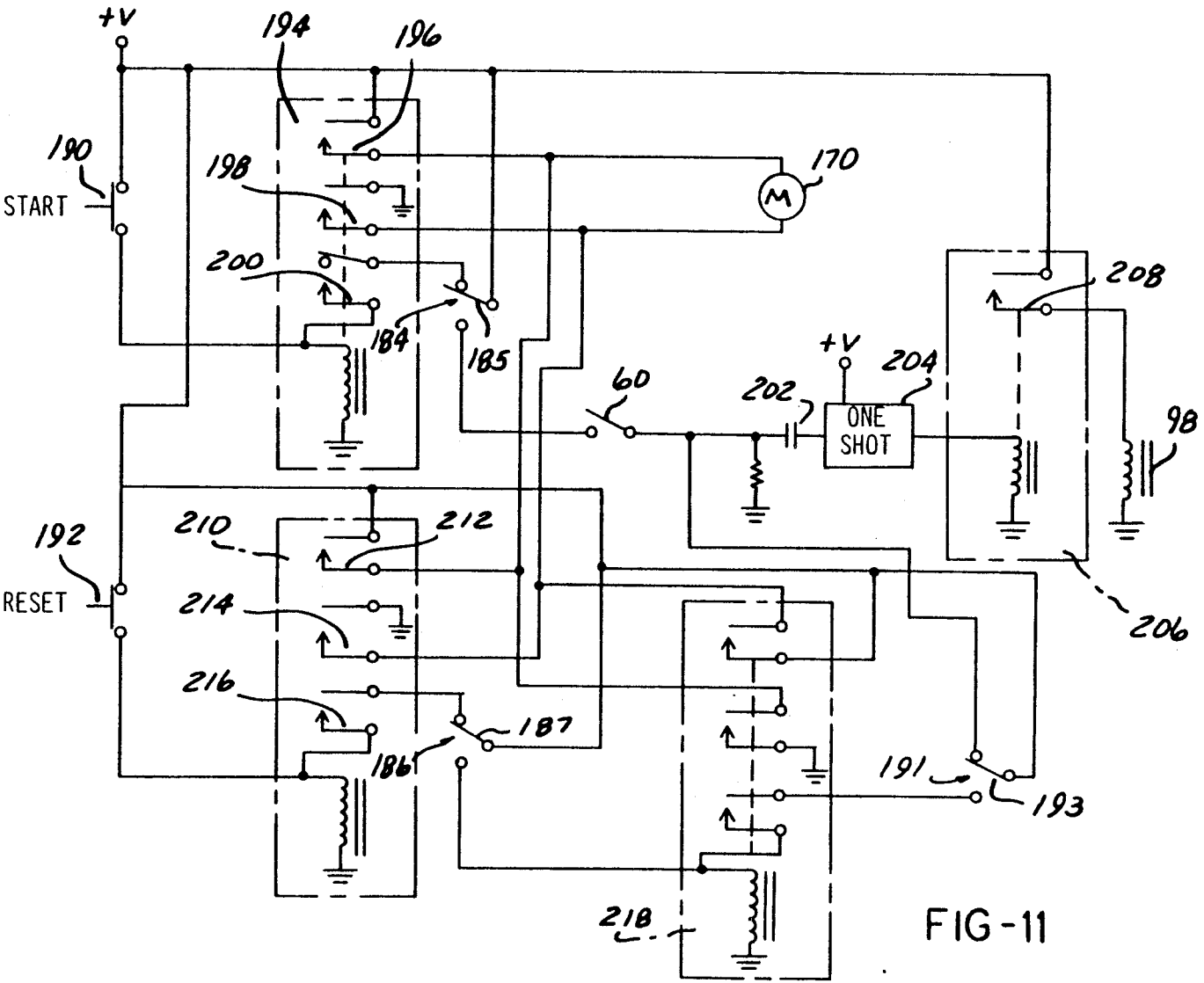
FIG. 11 a schematic diagram showing the control circuitry used to operate the conformable seat of the present invention.

A cam 182, FIG. 10, is mounted on one end of the third tubular shaft 24 and alternately engages first, second and third switch means 184, 186 and 191, respectively, which may be in the form of limit switches having outwardly projecting fingers. The limit switches 184, 186 and 191 detect the limit of pivotal movement of the cam 182 as the third tubular shaft 24 rotates. The output signals from the switches 184, 186 and 191 are utilized by a control circuit shown in FIG. 11 to control the bidirectional rotation of the motor 170. The control circuit includes a start push button 190 and a reset push button 192 which are connected to a suitable source of electric power, such as the vehicle battery, if the seat 10 is mounted in a vehicle. A first latch relay 194 is connected to the start push button 190. When activated by depression of the start push button 190, the latch relay 194 latches in a closed position moving its switchable contacts 196, 198 and 200 into contact with fixed contacts to supply power to the motor 170 to rotate the motor 170 in a first direction. Power is disconnected from the motor 170 when the switchable contact 185 associated with the first limit switch 184 closes thereby indicating that the output shaft of the motor 170 has rotated the desired angular amount in one direction.

The contact 185 of the limit switch 184 is connected in series with the depth switch 60 which detects depression of the belt 30 when a user sits on the seat 10. This supplies electric power to a capacitor 202 which builds up charge sufficient to energize a one shot 204 which supplies a momentary current to a relay 206. Energization of the relay 206 causes its movable contact 208 to close thereby supplying power to the trigger solenoid 98 which latches the belts 30 in the desired conforming fixed position, as described above.

When the motor 170 is activated by the start push button 190, the pivotal outer support members 100 and 102 associated with each belt 30 will pivot inward during the first approximately 90° of rotation of the shafts 24 and 26 until the associated flanges 114 on the pivot links 112 engage one of the teeth 42 in the belts 30 thereby positioning the outer support means 100 and 102 at the desired position to retain the belt 30 in the desired conforming shape. During this time, the latch release cams 76 are also rotating and unlatch the associated belt spools 36 at 300° to 360° rotation of the tubular member 20 allowing the belts to unwind. Finally, at 360° rotation of the tubular member 20, the switch 184 is made which removes power from the motor 170 and applies power to the depth switch 60. The depth switch 60, when closed, causes the latches 84 to latch the belt spools 36 in a particular extended position.

A reset operation occurs whenever the reset push button 192 is depressed. This can occur after the user has moved out of the seat 10 or while the user is still seated on the seat 10. Depression of the reset push button 192 energizes another latch relay 210 and causes its movable contacts 212, 214 and 216 to engage fixed contacts and apply power to the motor 170 to cause the output shaft 172 of the motor 170 to rotate in the same direction as during the set operation. As the output shaft 172 rotates, the release cams 76 also rotate to release the respective belt spools 36. The pivotal outer support means 100 and 102 for each belt 30 will also be pivoted outward to the normal position.

Rotation of the output shaft 172 of the motor 170 will continue until the movable contact 187 of the second limit switch 186 is closed. Closure of this contact 187 breaks the supply of power to the motor 170 thereby deactivating the motor 170 and stopping further rotation of the first tubular member 20 and the third and fourth tubular shafts 24 and 26.

At the same time, power will be supplied to the third latch relay 218 causing the movable contacts thereof to switch positions and reverse the polarity of power to the motor 170. This causes the belts 30 to be rewound about the respective spools 36 and the support arms 100, 102 to retract to their normal, start positions. After about 360° of reverse rotation, the switch 191 is made and its contact 193 unlatches the relay 218 and removes power from the motor 170. The contact 193 also supplies momentary power through the closed contact of the depth sensing switch 60 to the one shot 204 to energize the relay 206 to activate the trigger solenoid 98 to reset the latches associated with the belts 30 and latch the belt spools 36 in the rewound reset position.

Figure 12:
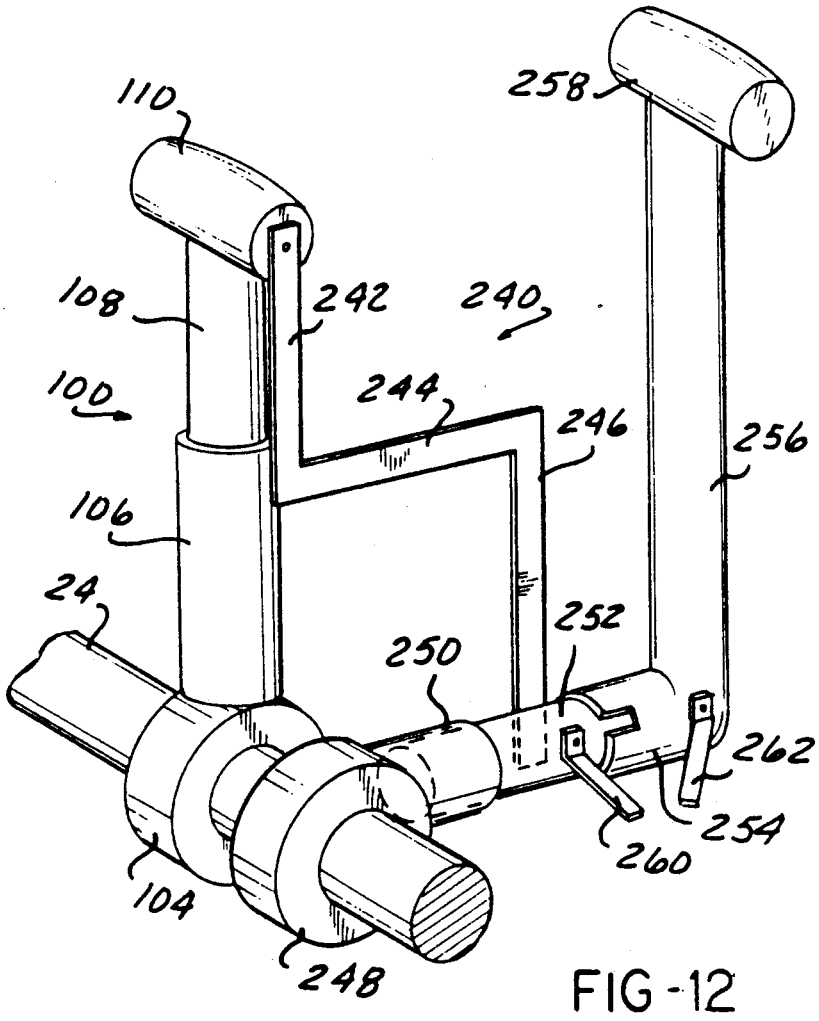
FIG. 12 is a perspective view showing an inner support member.
Figure 13:
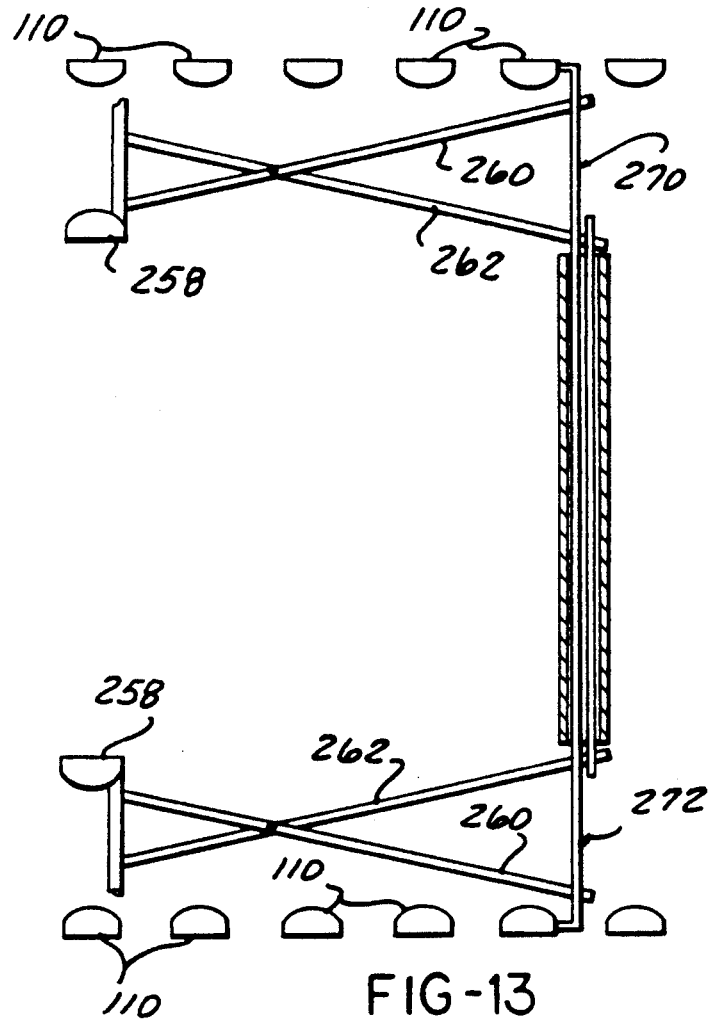
FIG. 13 is plan view showing the interconnection of the inner support members and the relative movement links.
Figure 14:
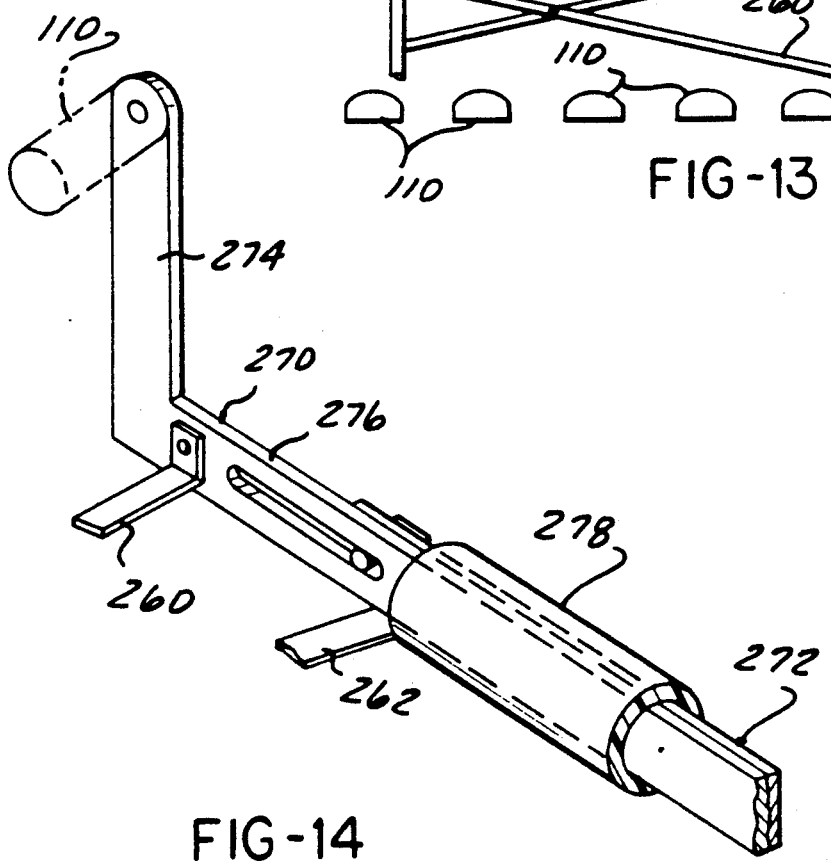
FIG. 14 is a partial perspective view showing the interconnection of the relative movement links to an outer support member.

The frontmost belt 30 toward the front end of the seat 10 is provided with inner leg supports to conform the inner portions of the frontmost belt 30 to the inner portions of the legs of a user of the seat 10. As shown in FIGS. 12, 13 and 14, a tracking link 240 has a first leg portion 242 pivotally connected at one end to one end of the tubular rod 110 of the outer support member 100. The tracking link 240 includes a central portion extending substantially horizontally from the first leg portion and a third leg 246 extending downward from the central portion 244.

The inner leg support also includes an annular collar 248 which is pivotally mounted about the third tubular shaft 24 adjacent to the annular base 104 of the first outer support means 100. A hollow first member 250 is joined to and extends outward from the annular collar 248 toward the opposed outer support means 102. A second member 252 is telescopingly and slidingly disposed within the first member 250 and is extensible and retractable with respect thereto. The third leg 246 of the tracking link 240 is pivotally connected to the second member 252 as shown in FIG. 12. The other end of the second member 252 is slidably disposed within a hollow end portion 254 of a inner leg support member 256. A tubular member 258 is joined to the upper end of the inner leg support member 256 and is disposed below and engages the bottom portion 40 of the endmost belt 30. An identical inner leg support is associated for the opposite outer support arm 102.

In this manner, the inner leg support member 256 will be positioned relative to the position of the first outer support arm 100. However, this position does not take into account the size of the user of the seat 10. Size information is obtained by a pair of transfer links 260 and 262 associated with each of the inner leg support means. The tracking transfer links 260 and 262 comprise elongated, planar members which are pivotally connected adjacent one end as shown in FIG. 13. One end portion of the tracking transfer link 260 is connected to the second member 252 as shown in FIG. 12; while one end of the other tracking transfer link 262 is connected to the inner leg support member 256, as also shown in FIG. 12.

The tracking transfer links 260 and 262 extend from the frontmost inner leg support members 256 rearward along the length of the seat 10 to a connection point with one pair of rearmost outer support means 100 and 102 and relative movement links as described hereafter.

As shown in FIGS. 13 and 14, a pair of relative movement links 270 and 272 extend between the outer support arms 100 and 102. The relative movement links 270 and 272 are identically constructed and, as shown in FIG. 14 for the relative movement link 270, each of the relative movement links 270 and 272 includes an upwardly extending leg portion 274 which is pivotally connected at an upper end to the tubular rod 110 associated with a rearmost outer pivotal support means 100 or 102. A central elongated portion 276 of the first relative movement link 270 extends perpendicular from the leg 274 through a hollow guide tube 278. Likewise, the second relative movement link 272 extends through the hollow guide tube 278 as shown in FIG. 14. The other end of the second relative movement link 272 is pivotally connected to an opposite tubular member 110 on an opposite outer pivotal support means.

As shown in FIGS. 13 and 14, the tracking transfer links 260 and 262 associated with one of the inner leg supports are alternately connected to the first relative movement link 270 and the second relative movement link 272. In this manner, the size of the user of the seat 10 as determined by the spacing between a rearmost outer support means 100 and 102 is transferred through the scissor-like connection of the tracking transfer links 260 and 262 to the inner leg support means to position the inner leg support member 256 at the proper position relative to the size of the user of the seat 10.

Figure 15:
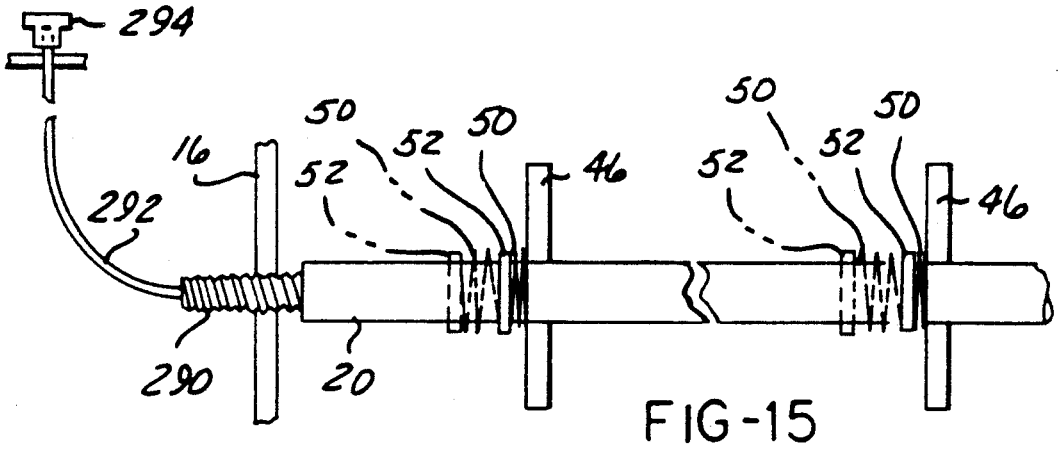
FIG. 15 is a partial, side elevational view showing an alternate embodiment of the belt spool latch means.

In an optional embodiment, as shown in FIG. 15, the seat 10 may be designed to conform to users of widely varying weights. This is accomplished by varying the belt spool 36 friction preload. In this embodiment, the first tubular member 20 is movably disposed longitudinally along the length of the seat 10. A threaded stop 290 threadingly extends through a portion of the frame 16 into engagement with one end of the first tubular member 20. A flexible cable 292 is connected to one end of the stop 290 and to a rotatable knob 294 at another end. Rotation of the knob 294 causes rotation of the stop 290 so as to threadingly extend or retract the stop 290 relative to the frame 16 and thereby transversely move the first tubular member 20 with respect to the frame 16. This has the effect of varying the compression force on the biasing spring 50 for each friction brake 46 associated with each belt spool 36. In this manner, the compression force of the spring 50 may be varied as shown in the solid and phantom positions in FIG. 15 so as to accommodate the seat 10 to a user's weight thereby enabling the seat 10 to be used by users having widely varying weights.

Figure 16:
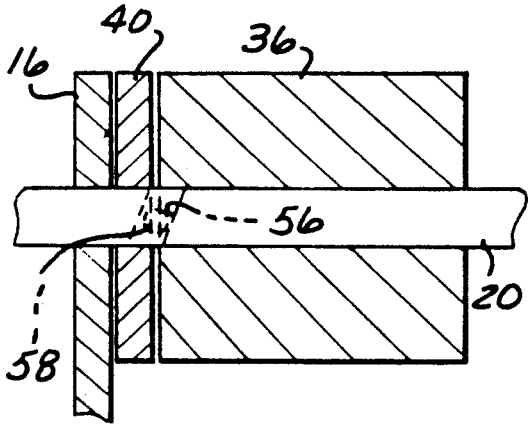
FIG. 16 is a partially cross sectioned, side elevational view of embodiment of a belt spool latch means.

In another embodiment shown in FIG. 16, the braking action of the friction brake 46 on the spool 36 is applied by the balls and ramps 56 and 58 formed in one end face of the spool 36. Greater user weight results in a greater brake pressure through translation of the balls 58 in the ramps 56 and thereby greater frictional contact with the friction brake 46. This weight adjustment can be used in place of the weight adjustment described above and shown in FIG. 15.

Figure 17:
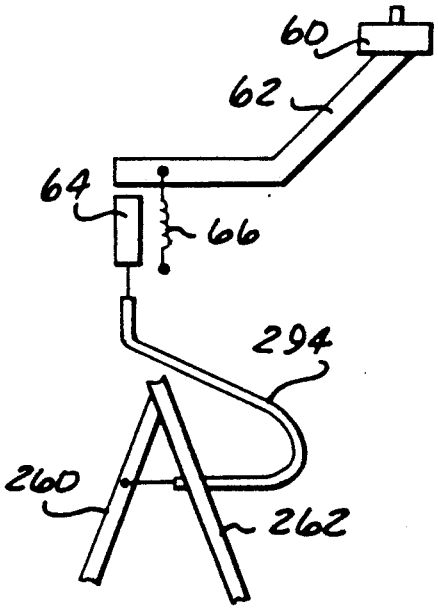
FIG. 17 is a schematic representation of another embodiment of the belt sensing means.

FIG. 17 depicts an alternate seat construction in which the position of the depth sensing switch 60 below one of the belts 30 is increased or decreased to allow a greater adjustment margin than that described above. This enables a deeper or shallower position of the user on the seat 10. In this embodiment, the switch stop 64 is connected via a pivotal cable 294 to one of the transfer tracking links 260. The position of the tracking link 260 causes an adjustment in the position of the switch stop 64 thereby accommodating the position of the depth sensing switch 60 to the size of the actual user of the seat 10. Alternately, the position of the switch stop 64 could be directly controlled by a user operated control knob, not shown, mounted on the seat.

Figure 18A:
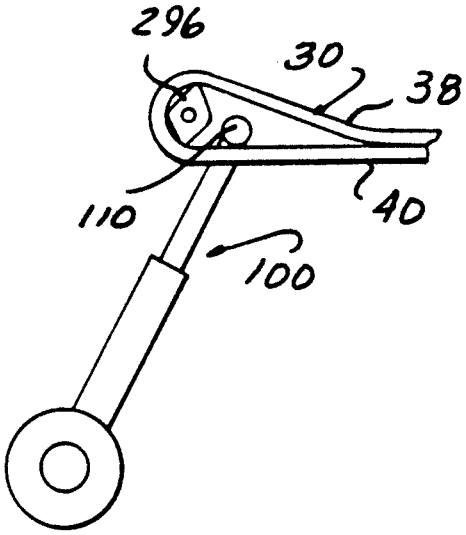
FIGS. 18A and 18B depict additional alternate embodiments of the belt loop second tubular member.
Figure 18B:
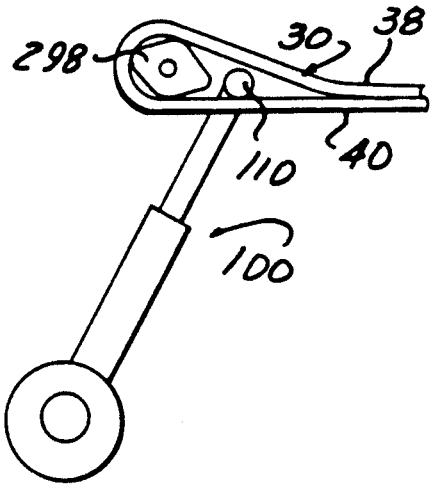

Finally, FIGS. 18A and 18B depict alternate configurations for the tubular member 22 and idler shaft 23 which provide adjustment in the degree of fit, i.e., loose or tight, of the seat 10 about a user. This is accomplished by varying the shape of both members, with only one member being illustrated in FIGS. 18A and B. In FIG. 18A, the tubular member 296 has a generally elliptical or oval shape with the longest length dimension extending in a substantially vertical direction in the frame 16. This increases the spacing between the top and bottom portions 38 and 40 of the belt 30 thereby allowing the tubular rod 110 of the pivotal support arm 100 to move inward a greater distance to thereby more tightly conform the belt 30 about the user. Alternately, as shown in FIG. 18B, an elliptical or oval-shaped tubular member 298 is oriented with its longest length dimension in a substantially horizontal direction. This decreases the space in between the top and bottom portions 38 and 40 of the belt 30 and causes the tubular member 110 of the pivotal support means 100 to remain further outward from the point of contact of the top and bottom portions 38 and 40 of the belt 30 and provide a looser fit of the belt 30 about a user.

In summary, there has been disclosed a unique conformable seat which automatically and quickly conforms to the shape, size and position of a use of the seat. The conformable seat is of simplified construction and contains a smaller number of components than previously devised similar conformable seats for a lower manufacturing cost. The conformable seat is also designed to complete its conforming and retraction cycles in an expeditious manner.

What is claimed is:

1. A conformable member comprising:

a frame;

first and second tubular members mounted on opposite sides of the frame, at least the first tubular member being rotatably mounted on the frame;

a plurality of belts spaced along the frame, each of the belts forming a loop having top and bottom opposed portions, the loop of each belt extending around the second tubular member and fixedly connected to the first tubular member and wound in an extensible number of turns about the first tubular member;

belt lock means for locking each belt in a set length between the first and second tubular members;

outer support means, mounted on the frame and associated with each belt, for engaging the belt adjacent the area of contact between the top and bottom portions of each belt after a user has contacted the belt urging the top portion of each belt into contact with the bottom portion of each belt;

means for locking the outer support means in a position engaged with the belt; and means for rotating the outer support means and the belt lock means between positions.

2. The conformable member of claim 1 wherein the outer support means comprises:

third and fourth shafts rotatably mounted on opposite sides of the frame below the first and second tubular members, respectively;

pairs of first and second co-planar outer support arms, the first outer support arm of each pair of outer support arms rotatably mounted on the third shaft and the second outer support arm of each pair of outer support arms rotatably mounted on the fourth shaft;

each of the first and second outer support arms including a base rotatably mounted on the respective third and fourth shafts and an extension member extensibly and retractably mounted within the base, the upper end of the extension member disposed between the top and bottom portions of the associated belt adjacent one of the first and second tubular members;

means, mounted on each of the first and second outer support arms, for releasably latching the extension member of each of the first and second outer support arms in an extended position; and means, mounted on each of the first and second outer support arms, for releasably latching the base member of each of the first and second outer support arms in a fixed position.

3. The conformable member of claim 2 wherein the means for releasably latching the base member comprises:

friction brake means, mounted on the respective third and fourth shafts adjacent the base member of each of the first and second outer support arms, for frictionally engaging the base member of one of the first and second outer support arms to transmit rotation of the respective third and fourth shafts to the associated base member.

4. The conformable member of claim 3 wherein the friction brake means comprises:

an annular friction brake disk slidingly mounted on one of the third and fourth shafts adjacent the base member of each of the first and second outer support arms; and biasing means mounted on one of the third and fourth shafts to bias the friction brake disk into contact with the base member.

5. The conformable member of claim 2 wherein the outer support means further includes:

means, extending between the extension member latching means and the base member latching means for connecting the two latch means together for simultaneous movement between latched and unlatched positions.

6. The conformable member of claim 5 further including:

cam means mounted on the third and fourth shafts adjacent each of the base members; and cam follower means, mounted on the base member latch means and engaging the cam means as the cam means rotates with rotation of the third and fourth shafts, for moving the extension member latching means and the base member latching means.

7. The conformable member of claim 2 further including:

a first pair of first and second inner support members positioned adjacent one end of the frame and associated with an endmost one of the belts and an endmost pair of outer support arms;

each of the first and second inner support members including an elongate member having upper and lower ends, the upper end being disposed between the top and bottom portions of the endmost one of the belts.

8. The conformable member of claim 7 further including:

a first member pivotally connected to each of the third and fourth rotatable shafts;

a second member slidingly and extensibly mounted in and extending outward from the first member, the second member coupled to the lower end of the elongate member; and a transfer link connected between the upper end of the extension member of the associated outer support arms and the second member to position the second member relative to the first member in response to the position of the associated outer support arm.

9. The conformable member of claim 8 further including:

a pair of relative movement links connected to and extending between another pair of outer support arms, spaced from the endmost pair of support arms; and first and second pairs of tracking transfer links pivotally connected together at an intermediate portion and extending between and connected to the relative movement links and the second member and the elongate member of opposed pairs of inner support arms.

10. The conformable member of claim 2 wherein:

at least the top portion of each belt includes a plurality of spaced recesses facing the bottom portion of each belt;

a link associated with the extension member of each of the outer support arms, each link having first and second ends, the first end being pivotally connected to the upper end of the extension member, and the second end being releasably engageable with one of the recesses in the top portion of the belt to lock the outer support arm in a fixed position relative to the belt.

11. The conformable member of claim 1 wherein the belt lock means comprises:

a belt spool rotatably mounted on the first tubular member, one end of the belt connected to the spool for extension and retraction movement relative to the spool; and friction brake means mounted on the first tubular member adjacent to and frictionally engaging the spool for transmitting rotation of the first tubular member to the spool.

12. The conformable member of claim 6 wherein the friction brake means comprises:

an annular friction brake disk slidingly mounted on the first tubular member adjacent the belt spool;

biasing means mounted on the first tubular member for biasing the friction brake disk into contact with the belt spool; and means for varying the biasing force of the biasing means on the friction brake disk, the varying means including:

a rotatable position selector member;

the first tubular member being slidingly mounted in the frame for transverse movement; and means, responsive to rotation of the position selector member and connected to the first tubular member, for varying the position of the first tubular member relative to the frame in response to rotation of the position selector member.

13. The conformable member of claim 1 further including:

switch means, mounted on the frame and spaced below one of the belts, the switch means generating an output signal when contacted by the belt when the belt is depressed by a user engaging the conformable member.

14. The conformable member of claim 1 further including:

a pair of first and second inner support members positioned adjacent one end of the frame and associated with an endmost one of the belts and the outer support means;

each of the first and second inner support members including an elongate member having upper and lower ends, the upper end being disposed between the top and bottom portions of the endmost one of the belts; and means, coupled to the outer support means and the lower end of the elongate member, for positioning the elongate member relative to the outer support means.

15. The conformable member of claim 14 further including:

means, responsive to the position of the support means associated with another belt on the frame and coupled to the elongate member positioning means, for varying the position of the elongate member relative to the outer support means in response to the position of the outer support means associated with the other belt.

* * * * *